US006071659A

United States Patent [19]

Renfer et al.

[11] Patent Number: 6,071,659

[45] Date of Patent: Jun. 6, 2000

[54] STABILIZED OVERCOAT COMPOSITIONS

[75] Inventors: Dale S. Renfer, Webster; Damodar M. Pai, Fairport; Paul J. DeFeo, Sodus Point; John F. Yanus, Webster; William W. Limburg, Penfield; Timothy J. Fuller, Pittsford, all of N.Y.

[73] Assignee: Xerox Corporation, Stamford, Conn.

[21] Appl. No.: 09/218,928

[22] Filed: Dec. 22, 1998

[51] Int. Cl.[7] ..... G03G 5/147

[52] U.S. Cl. ..... 430/59.6; 430/66; 430/132

[58] Field of Search ..... 430/66, 58.7, 58.8, 430/132

[56] References Cited

U.S. PATENT DOCUMENTS

| | | | |
|---|---|---|---|
| 4,050,935 | 9/1977 | Limburg et al. | 430/66 |
| 4,281,054 | 7/1981 | Horgan et al. | 430/59 |
| 4,297,425 | 10/1981 | Pai et al. | 430/58 |
| 4,457,994 | 7/1984 | Pai et al. | 430/59 |
| 4,599,286 | 7/1986 | Limburg et al. | 430/59 |
| 4,871,634 | 10/1989 | Limburg et al. | 430/54 |
| 5,368,967 | 11/1994 | Schank et al. | 430/59 |
| 5,702,854 | 12/1997 | Schank et al. | 430/66 |
| 5,709,974 | 1/1998 | Yuh et al. | 430/66 |

*Primary Examiner*—John Goodrow

[57] ABSTRACT

An electrophotographic imaging member including a substrate, a charge generating layer, a charge transport layer, and an overcoat layer including a hole transporting hydroxy arylamine compound having at least two hydroxy functional groups, bis-(2-methyl-4-diethylaminophenyl)-phenylmethane and a cross linked polyamide film forming binder.

A process for forming an overcoated imaging member is also disclosed.

13 Claims, No Drawings

STABILIZED OVERCOAT COMPOSITIONS

BACKGROUND OF THE INVENTION

This invention relates in general to electrophotographic imaging members and, more specifically, to layered photoreceptor structures with overcoatings containing stabilized hydrogen bonded materials and processes for making and using the photoreceptors.

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

Many advanced imaging systems are based on the use of small diameter photoreceptor drums. The use of small diameter drums places a premium on photoreceptor life. A major factor limiting photoreceptor life in copiers and printers, is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the micro corona generated by the BCR during charging, damages the photoreceptor, resulting in rapid wear of the imaging surface, e.g., the exposed surface of the charge transport layer. For example wear rates can be as high as about 16 $\mu$ per 100,000 imaging cycles. Similar problems are encountered with bias transfer roll (BTR) systems. One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear, avoidance of perturbation of underlying layers during coating. Although various hole transporting small molecules can be used in overcoating layers, one of the toughest overcoatings discovered comprises cross linked polyamide (e.g. Luckamide) containing N,N'-diphenyl-N,N'-bis(3-hydroxyphenyl)-[1,1'-biphenyl]-4,4'-diamine (DHTBD). This tough overcoat is described in U.S. Pat. No. 5,368,967, the entire disclosure thereof being incorporated herein by reference.

Since N,N'-diphenyl-N,N'-bis(3-hydroxyphenyl)-[1,1'-biphenyl]-4,4'-diamine is sensitive to the oxidative species produced by the various charging devices, a chemical stabilizer is desirable for longer imaging member cycling life. An improved overcoating has been achieved with cross linked polyamide (e.g., Luckamide) and N,N'-diphenyl-N,N'-bis(3-hydroxyphenyl)-[1,1'-biphenyl]-4,4'-diamine and bis-[2-methyl-4-(N-2-hydroxyethyl-N-ethyl-aminophenyl)]-phenylmethane (DHTPM) as an image deletion stabilizer material. Although excellent overcoatings have been achieved with bis-[2-methyl-4-(N-2-hydroxyethyl-N-ethyl-aminophenyl)]-phenylmethane as the stabilizer, bis-[2-methyl-4-(N-2-hydroxyethyl-N-ethyl-aminophenyl)]-phenylmethane is difficult to purify and handle. Moreover, it is expensive, a semi-solid at room temperature and oxidized relatively easily as evidenced by color change of the material during storage. However, since bis-[2-methyl-4-(N-2-hydroxyethyl-N-ethyl-aminophenyl)]-phenylmethane is soluble in alcohols, the solvents required for forming coatings containing polyamide (e.g. Luckamide), it can be solution coated with a polyamide.

INFORMATION DISCLOSURE STATEMENT

U.S. Pat. No. 5,368,967 issued to Schank et al. on Nov. 29, 1994—An electrophotographic imaging member is disclosed comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis(3-hydroxyphenyl)-[1,1'-biphenyl]-4,4'-diamine and bis-[2-methyl-4-(N-2-hydroxyethyl-N-ethyl-aminophenyl)]-phenylmethane are disclosed in this patent.

U.S. Pat. No. 4,871,634 to Limburg et al., issued Oct. 3, 1989—An electrostatographic imaging member is disclosed which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,297,425 to Pai et al., issued Oct. 27, 1981—A layered photosensitive member is disclosed comprising a generator layer and a transport layer containing a combination of diamine and triphenyl methane molecules dispersed in a polymeric binder.

U.S. Pat. No. 4,050,935 to Limburg et al., issued Sep. 27, 1977—A layered photosensitive member is disclosed comprising a generator layer of trigonal selenium and a transport layer of bis(4-diethylamino-2-methylphenyl) phenylmethane molecularly dispersed in a polymeric binder.

U.S. Pat. No. 4,457,994 to Pai et al. et al, issued Jul. 3, 1984—A layered photosensitive member is disclosed comprising a generator layer and a transport layer containing a diamine type molecule dispersed in a polymeric binder and an overcoat containing triphenyl methane molecules dispersed in a polymeric binder.

U.S. Pat. No. 4,281,054 to Horgan et al., issued Jul. 28, 1981—An imaging member is disclosed comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat No. 5,702,854 to Schank et al., issued Dec. 30, 1998—An electrophotographic imaging member is disclosed including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 4,599,286 to Limburg et al., issued Jul. 8, 1982—An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

CROSS REFERENCE TO COPENDING APPLICATIONS

U.S. patent application Ser. No. 09/182,602 filed in the names of Yanus et al., entitled "OVERCOATING COMPOSITIONS, OVERCOATED PHOTORECEPTORS, AND METHODS OF FABRICATING AND USING OVERCOATED PHOTORECEPTORS", filed via Express Mail on Oct. 29, 1998—An electrophotographic imaging member is disclosed including a supporting substrate coated with at least photoconductive layer, a charge transport layer and an overcoating layer, the overcoating layer including a hydroxy functionalized aromatic diamine and a hydroxy functionalized triarylamine dissolved or molecularly dispersed in a crosslinked polyamide matrix, the crosslinked polyamide prior to crosslinking being selected from the group consisting of materials represented by the following Formulae I and II:

I

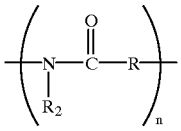

wherein:

n is a positive integer sufficient to achieve a weight average molecular weight between about 5000 and about 100,000, R is an alkylene unit containing from 1 to 10 carbon atoms, between 1 and 99 percent of the $R_2$ sites are —H, and the remainder of the $R_2$ sites are —$CH_2$—O—$CH_3$, and

II

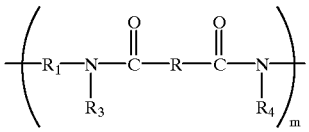

wherein:

m is a positive integer sufficient to achieve a weight average molecular weight between about 5000 and about 100000, $R_1$ and R are independently selected from the group consisting of alkylene units containing from 1 to 10 carbon atoms, and between 1 and 99 percent of the $R_3$ and $R_4$ sites are —H, and the remainder of the $R_3$ and $R_4$ sites are —$CH_2$—O—$CH_3$.

Coating compositions for the overcoating layer of this invention as well as methods of making and using the overcoated photoreceptor are also disclosed.

U.S Pat. No. 5,976,744, filed in the names of Fuller et al., entitled "PHOTORECEPTOR OVERCOATINGS CONTAINING HYDROXY FUNCTIONALIZED AROMATIC DIAMINE, HYDROXY FUNCTIONALIZED TRIARYLAMINE AND CROSSLINKED ACRYLATED POLYAMIDE", filed on Oct. 29, 1998, —An electrophotographic imaging member including a supporting substrate coated with at least one photoconductive layer, and an overcoating layer, the overcoating layer including a a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine, the crosslinked polyamide prior to crosslinking being selected from the group consisting of materials represented by the following Formulae I and II:

I

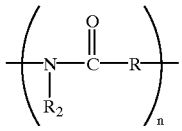

wherein:

n is a positive integer sufficient to achieve a weight average molecular weight between about 5000 and about 100,000, R is an alkylene group containing from 1 to 10 carbon atoms, between 1 and 99 percent of the $R_2$ sites are

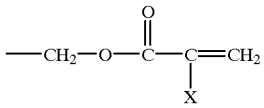

wherein X is selected from the group consisting of —H (acrylate), —$CH_3$(methacrylate), alkyl and aryl, and the remainder of the $R_2$ sites are selected from the group consisting of —H, —$CH_2OCH_3$, and —$CH_2OH$, and

II

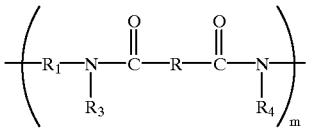

wherein:

m is a positive integer sufficient to achieve a weight average molecular weight between about 5000 and about 100000, R and $R_1$ are independently selected from the group consisting of alkylene units containing from 1 to 10 carbon atoms;

between 1 and 99 percent of $R_3$ and $R_4$ are independently selected from the group consisting of

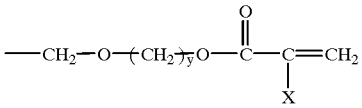

wherein

X is selected from the group consisting of hydrogen, alkyl, aryl and alkylaryl, wherein the alkyl groups contain 1 to 10 carbon atoms and the aryl groups contain 1 to 3 alkyl groups, y is an integer between 1 and 10, and the remainder of the $R_3$ and $R_4$ groups are selected from the group consisting of —H, —$CH_2OH$, —$CH_2OCH_3$, and —$CH_2OC(O)$—C(X)=$CH_2$.

The overcoating layer is formed by coating. The electrophotographic imaging member may be imaged in a process.

U.S. patent application Ser. No. 6,004,709, filed in the names of D. Renfer et al., entitled "ALLYLOXYPOLYAMIDE SYNETHESIS, COMPOSITIONS AND DEVICES", filed concurrently herewith, —An allyloxypolyamide composition iS disclosed, the allyloxypolyamide being represented by a specific formula The allyloxypolyamide may be synthesized by reacting an alcohol soluble polyamide with formaldehyde and an allylalcohol.

The allyloxypolyamide may be cross linked by a process selected from the group consisting of (a) heating an allyloxypolyamide in the presence of a free radical catalyst, and (b) hydrosilation of the double bond of the allyloxy group of the allyloxypolyamide with a silicon hydride reactant having at least 2 reactive sites.

A preferred article comprises a substrate, at least one photoconductive layer, and an overcoat layer comprising a hole transporting hydroxy arylamine compound having at least two hydroxy functional groups, and a cross linked allyloxypolyamide film forming binder. A stabilizer may be added to the overcoat.

BRIEF SUMMARY OF THE INVENTION

It is, therefore, an object of the present invention to provide an improved electrophotographic imaging member and process for fabricating the member.

It is another object of the present invention to provide an improved imaging member containing a stabilizer that is easier to handle.

It is still another object of the present invention to provide an improved imaging member containing a stabilizer that is inexpensive.

It is yet another object of the present invention to provide an improved imaging member overcoated with a tough overcoating which resists wear.

It is another object of the present invention to provide an improved imaging member which contains an alcohol insoluble stabilizer in a cross liked polyamide.

It is still another object of the present invention to provide an improved imaging member with materials that are easy to synthesize and purify.

The foregoing objects and others are accomplished in accordance with this invention by providing an electrophotographic imaging member comprising a substrate, a charge generating layer, a charge transport layer, and an overcoat layer comprising a uniform homogeneous blend of a hole transporting hydroxy arylamine compound having at least two hydroxy functional groups, bis-(2-methyl-4-diethylaminophenyl)-phenylmethane and a cross linked polyamide film forming binder.

The electrophotographic imaging member is fabricated by forming a coating solution comprising bis-(2-methyl-4-diethylaminophenyl)-phenylmethane, an alcohol miscible nonalcoholic solvent for bis-(2-methyl-4-diethylaminophenyl)-phenylmethane, a hole transporting hydroxy arylamine compound having at least two hydroxy functional groups, an alcohol and a cross linkable polyamide film forming binder, providing a substrate coated with at least one electrophotographic imaging layer, forming a coating with the coating solution on the at least one electrophotographic imaging layer, and drying the coating and cross linking the polyamide to form an overcoating layer. Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions as is well known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"- diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up in machines with high throughput, the charge transport layer should be substantially free (less than about two percent) of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine.

Any suitable electrically inactive resin binder insoluble in the alcohol solvent used to apply the overcoat layer may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Preferred binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), and the like. Any suitable charge transporting polymer may also be utilized in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The solution employed to form the overcoat layer of this invention comprises

- bis-(2-methyl-4-diethylaminophenyl)-phenylmethane [BDETPM], an alcohol miscible nonalcoholic solvent for bis-(2-methyl-4-diethylaminophenyl)-phenylmethane,
- a hole transporting hydroxy arylamine compound having at least two hydroxy functional groups,
- an alcohol and
- a polyamide film forming binder capable of forming hydrogen bonds with the hydroxy functional groups of the hydroxy arylamine compound.

Bis-(2-methyl-4-diethylaminophenyl)-phenylmethane can be represented by the following formula:

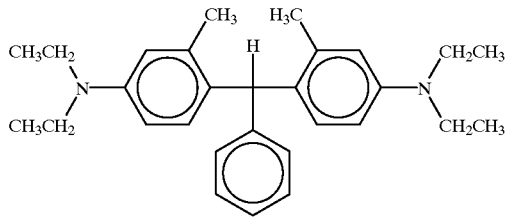

Bis-(2-methyl-4-diethylaminophenyl)-phenylmethane is insoluble in alcohol and will not form a solution with a mixture of a hole transporting hydroxy arylamine compound having at least two hydroxy functional groups, an alcohol and a polyamide film forming binder. Thus, attempts to use the aforesaid combination as an overcoat fail because a uniform homogeneous coating cannot be formed because the overcoat contains particles of undissolved bis-(2-methyl-4-diethylaminophenyl)-phenylmethane.

The overcoat coating composition also comprises a solvent which dissolves bis-(2-methyl-4-diethylaminophenyl)-phenylmethane, the solvent also being miscible with alcohol. Typical solvents which dissolve bis-(2-methyl-4-diethylaminophenyl)-phenylmethane, and are also miscible with alcohol include, for example, tetrahydrofuran, chlorobenzene, dichloromethane, dioxane, and the like. The expressions "dissolves" and "miscible" as employed herein are defined as solvents which form clear solutions with the other materials employed in the overcoat compositions of this invention. The solvent for bis-(2-methyl-4-diethylaminophenyl)-phenylmethane may be mixed with bis-(2-methyl-4-diethylaminophenyl)-phenylmethane prior to admixing with the alcohol and other components of the overcoating composition.

Any suitable alcohol soluble polyamide film forming binder capable for forming hydrogen bonds with hydroxy functional materials may be utilized in the overcoating of this invention. The expression "hydrogen bonding" is defined as an attractive force or bridge occurring between the polar hydroxy containing arylamine and a hydrogen bonding resin in which a hydrogen atom of the polar hydroxy arylamine is attracted to two unshared electrons of a resin containing polarizable groups. The hydrogen atom is the positive end of one polar molecule and forms a linkage with the electronegative end of the other polar molecule. The polyamide utilized in the overcoating of this invention should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of polyhydroxy arylamine charge transporting monomer minimizes these variations. The alcohol soluble polyamide should be capable of dissolving in an alcohol solvent which also dissolves the hole transporting small molecule having multiple hydroxy functional groups. The polyamide polymers of this invention are characterized by the presence of the amide group —CONH. Typical polyamides include the various Elvamide resins which are nylon multipolymer resins, such as the alcohol soluble Elvamide and Elvamide TH resins. Elvamide resins are available from E.I. DuPont Nemours and Company. Other examples of polyamides include Elvamide 8061, Elvamide 8064, Elvamide 8023.

Any suitable hole insulating film forming alcohol soluble crosslinkable polyamide polymer having methoxy methyl groups attached to the nitrogen atoms of amide groups in the polymer backbone prior to crosslinking may be employed in the overcoating of this invention. A preferred alcohol soluble polyamide polymer having methoxy methyl groups attached to the nitrogen atoms of amide groups in the polymer backbone prior to crosslinking is selected from the group consisting of materials represented by the following Formulae I and II:

I

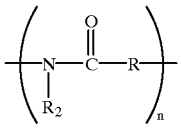

II

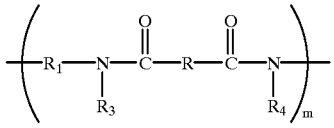

wherein:

n is a positive integer sufficient to achieve a weight average molecular weight between about 5000 and about 100,000, R is an alkylene unit containing from 1 to 10 carbon atoms, between 1 and 99 percent of the $R_2$ sites are —H, and the remainder of the $R_2$ sites are —$CH_2$—O—$CH_3$, and wherein:

m is a positive integer sufficient to achieve a weight average molecular weight between about 5000 and about 100000, $R_1$ and R are independently selected from the group consisting of alkylene units containing from 1 to 10 carbon atoms, and between 1 and 99 percent of the $R_3$ and $R_4$ sites are —H, and the remainder of the $R_3$ and $R_4$ sites are —$CH_2$—O—$CH_3$.

For R in Formula I, optimum results are achieved when the number of alkylene units containing less than 6 carbon atoms are about 40 percent of the total number of alkylene units. For R and $R_1$ in Formula II, optimum results are achieved when the number of alkylene units containing less than 6 carbon atoms are about 40 percent of the total number of alkylene units. Preferably, the alkylene unit R in polyamide Formula I is selected from the group consisting of $(CH_2)_4$ and $(CH_2)_6$, the alkylene units $R_1$ and $R_2$ in polyamide Formula II are independently selected from the group consisting of $(CH_2)_4$ and $(CH_2)_6$, and the concentration of $(CH_2)_4$ and $(CH_2)_6$ is between about 40 percent and about 60 percent of the total number of alkylene units in the polyamide of the polyamide of Formula I or the polyamide of Formula II. Between about 1 percent and about 50 mole percent of the total number of repeat units of the polyamide polymer should contain methoxy methyl groups attached to the nitrogen atoms of amide groups. These polyamides should form solid films if dried prior to crosslinking. The polyamide should also be soluble, prior to crosslinking, in the alcohol solvents employed.

A preferred polyamide is represented by the following formula:

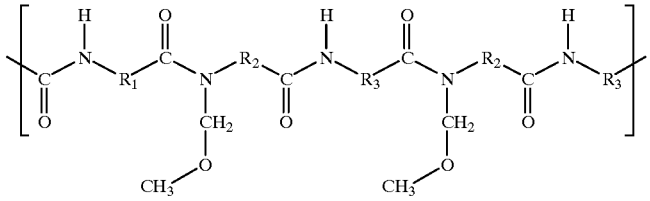

wherein $R_1$, $R_2$ and $R_3$ are alkylene units independently selected from units containing from 1 to 10 carbon atoms, and n is a positive integer sufficient to achieve a weight average molecular weight between about 5000 and about 100,000.

For R, $R_1$ and $R_3$ in Formula II, optimum results are achieved when the number of alkylene units containing less than 6 carbon atoms are about 40 percent of the total number of alkylene units.

Typical alcohols in which the polyamide is soluble include, for example, butanol, ethanol, methanol, and the like and mixtures thereof. Typical alcohol soluble polyamide polymers having methoxy methyl groups attached to the nitrogen atoms of amide groups in the polymer backbone prior to crosslinking include, for example, hole insulating alcohol soluble polyamide film forming polymers such as Luckamide 5003 from Dai Nippon Ink, Nylon 8 with methylmethoxy pendant groups, CM4000 from Toray Industries, Ltd. and CM8000 from Toray Industries, Ltd. and other N-methoxymethylated polyamides, such as those prepared according to the method described in Sorenson and Campbell "Preparative Methods of Polymer Chemistry" second edition, pg. 76, John Wiley & Sons Inc. 1968, and the like and mixtures thereof. These polyamides can be alcohol soluble, for example, with polar functional groups, such as methoxy, ethoxy and hydroxy groups, pendant from the polymer backbone. It should be noted that polyamides, such as Elvamides from DuPont de Nemours & Co., do not contain methoxy methyl groups attached to the nitrogen atoms of amide groups in the polymer backbone. The overcoating layer of this invention preferably comprises between about 30 percent by weight and about 70 percent by weight of the crosslinked film forming crosslinkable alcohol soluble polyamide polymer having methoxy methyl groups attached to the nitrogen atoms of the amide groups in the polymer backbone, based on the total weight of the overcoating layer after crosslinking and drying. Crosslinking is accomplished by heating in the presence of a catalyst. Any suitable catalyst may be employed. Typical catalysts include, for example, oxalic acid, maleic acid, carbollylic acid, ascorbic acid, malonic acid, succinic acid, tartaric acid, citric acid, p-toluenesulfonic acid, methanesulfonic acid, and the like and mixtures thereof. The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific polyamide, catalyst, temperature and time used for the reaction. A typical crosslinking temperature used for Luckamide with oxalic acid as a catalyst is about 125° C. for 30 minutes. A typical concentration of oxalic acid is between 5 and 10 weight percent based on the weight of Luckamide. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the hydroxy functionalized transport molecule as a fish is caught in a gill net.

Any suitable alcohol solvent may be employed for the film forming polyamides. Typical alcohol solvents include, for example, butanol, propanol, methanol, and the like and mixtures thereof.

Any suitable polyhydroxy diaryl amine small molecule charge transport material having at least two hydroxy functional groups may be utilized in the overcoating layer of this invention. A preferred small molecule hole transporting material can be represented by the following formula:

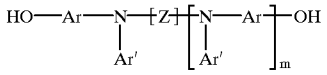

wherein:

m is 0 or 1,

Z is selected from the group consisting of:

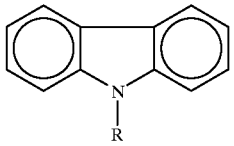

,

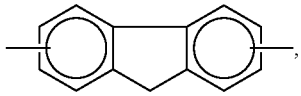

,

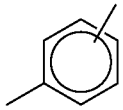

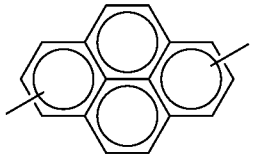

and

—Ar—(X)$_n$—Ar— n is 0 or 1,

Ar is selected from the group consisting of:

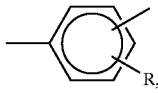

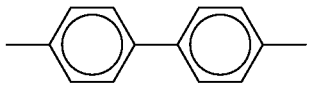

and

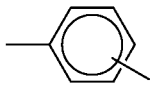

R is selected from the group consisting of —$CH_3$, —$C_2H_5$, —$C_3H_7$, and —$C_4H_9$, Ar' is selected from the group consisting of:

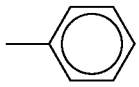

,

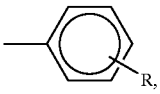

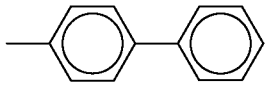

, and

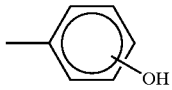

X is selected from the group consisting of:

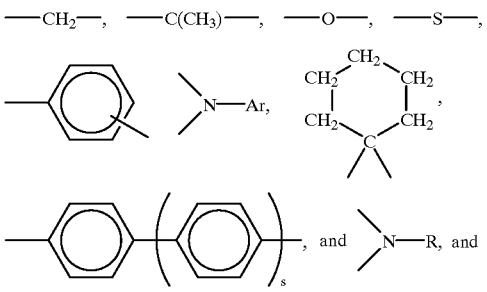

s is 0, 1 or2, the dihydroxy arylamine compound being free of any direct conjugation between the —OH groups and the nearest nitrogen atom through one or more aromatic rings.

The expression "direct conjugation" is defined as the presence of a segment, having the formula:

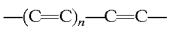

in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group.

Typical polyhydroxy arylamine compounds utilized in the overcoat of this invention include, for example: N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-m-hydroxyphenyl)-aminophenyl]-cyclohexane; 1,1-bis[4-(N-m-hydroxyphenyl)-4-(N-phenyl)-aminophenyl]-cyclohexane; Bis-(N-(3-hydroxyphenyl)-N-phenyl-4-aminophenyl)-methane; Bis[(N-(3-hydroxyphenyl)-N-phenyl)-4-aminophenyl]-isopropylidene; N,N'-diphenyl-N,N'-bis(3-hydroxyphenyl)-[1,1':4',1"-terphenyl]-4,4"-diamine; 9-ethyl-3.6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; 1,4-bis[N-phenyl-N-(3-hydroxyphenyl)]-phenylenediamine.

All the components utilized in the overcoating solution of this invention should be soluble in the mixture of alcohol and non-alcoholic bis-(2-methyl-4-diethylaminophenyl)-phenylmethane solvents employed for the overcoating. When at least one component in the overcoating mixture is not soluble in the solvent utilized, phase separation can occur which would adversely affect the transparency of the overcoating and electrical performance of the final photoreceptor. Generally, the weight ratio range of the components of the overcoating solution of this invention is 0.8 to 1.0 gram hydroxy arylamine compound:0.05 to 0.15 gram bis-(2-methyl-4-diethylaminophenyl)-phenylmethane:0.3 to 0.5 gram bis-(2-methyl-4-diethylaminophenyl)-phenylmethane non-alcoholic solvent:0.9 to 1.5 gram polyamide:8.0 to 15.0 gram alcohol. However, the specific amounts can vary depending upon the specific polyamide, alcohol and bis-(2-methyl-4-diethylaminophenyl)-phenylmethane:bis-(2-methyl-4-diethylaminophenyl)-phenylmethane non-alcoholic solvent selected. Preferably, the solvent mixture contains between about 85 percent and about 99 percent by weight of alcohol and between about 1 percent and about 15 percent by weight of bis-(2-methyl-4-diethylaminophenyl)-phenylmethane non-alcoholic solvent, based on the total weight of the solvents in the overcoat coating solution. A typical composition comprises 1 gram Luckamide, 0.9 gram DHTBD, 0.1 gram bis-(2-methyl-4-diethylaminophenyl)-phenylmethane, 5.43 gram methanol, 5.43 gram 1-propanol, 0.4 gram tetrahydrofuran and 0.08 gram oxalic acid.

Various techniques may be employed to form coating solutions containing bis-(2-methyl-4-diethylaminophenyl)-phenylmethane, polyamide and polyhydroxy diaryl amine small molecule. For example, the preferred technique is to dissolve bis-(2-methyl-4-diethylaminophenyl)-phenylmethane in a suitable alcohol soluble solvent such as tetrahydofuran prior to mixing with a solution of polyhydroxy diary amine (e.g. N,N'-diphenyl-N,N'-bis(3-hydroxyphenyl)-[1,1'-biphenyl]-4,4'-diamine) and polyamide in alcohol. Alternatively, from about 5 percent to about 20 percent (by weight, based on the total weight of solvents) of a co-solvent, such as chlorobenzene, may be mixed with polyhydroxy diaryl amine (e.g. N,N'-diphenyl-N,N'-bis(3-hydroxyphenyl)-[1,1'-biphenyl]-4,4'-diamine) and polyamide dissolved in alcohol followed by dissolving, with warming, bis-(2-methyl-4-diethylaminophenyl)-phenylmethane in the coating solution. Good films have been coated using these methods. Deletion testing of these compositions have shown that they perform equally well as bis-[2-methyl-4-(N-2-hydroxyethyl-N-ethyl-aminophenyl)]-phenylmethane at the same concentrations, such as at 10 weight percent N,N'-diphenyl-N,N'-bis(3-hydroxyphenyl)-[1,1'-biphenyl]-4,4'-diamine [DHTBD]. N,N'-diphenyl-N,N'-bis(3-hydroxyphenyl)-[1,1'-biphenyl]-4,4'-diamine, can be represented by the following formula:

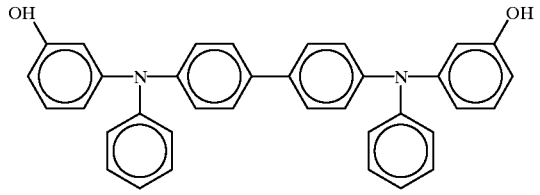

Bis-[2-methyl-4-(N-2-hydroxyethyl-N-ethyl-aminophenyl)]-phenylmethane (DHTPM) can be represented by the following formula:

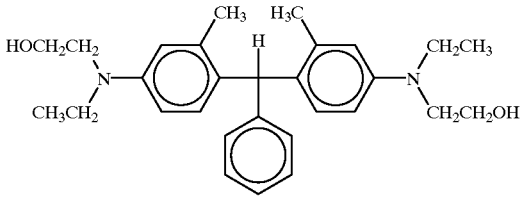

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be about the same as that of the unovercoated device.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Photoreceptors were prepared by forming coatings using conventional techniques on a substrate comprising a vacuum deposited titanium layer on a polyethylene terephthalate film. The first coating formed on the titanium layer was a siloxane barrier layer formed from hydrolyzed gamma aminopropyltriethoxysilane having a thickness of 0.005 micrometer (50 Angstroms). The barrier layer coating composition was prepared by mixing 3-aminopropyltriethoxysilane (available from PCR Research Center Chemicals of Florida) with ethanol in a 1:50 volume ratio. The coating composition was applied by a multiple clearance film applicator to form a coating having a wet thickness of 0.5 mil. The coating was then allowed to dry for 5 minutes at room temperature, followed by curing for 10 minutes at 110 degree centigrade in a forced air oven. The second coating was an adhesive layer of polyester resin (49,000, available from E.I. duPont de Nemours & Co.) having a thickness of 0.005 micron (50 Angstroms). The second coating composition was applied using a 0.5 mil bar and the resulting coating was cured in a forced air oven for 10 minutes. This adhesive interface layer was thereafter coated with a photogenerating layer containing 40 percent by volume hydroxygallium phthalocyanine and 60 percent by volume of a block copolymer of styrene (82 percent)/4-vinyl pyridine (18 percent) having a Mw of 11,000. This photogenerating coating composition was prepared by dissolving 1.5 grams of the block copolymer of styrene/4-vinyl pyridine in 42 ml of toluene. To this solution was added 1.33 grams of hydroxygallium phthalocyanine and 300 grams of ⅛ inch diameter stainless steel shot. This mixture was then placed on a ball mill for 20 hours. The resulting slurry was thereafter applied to the adhesive interface with a Bird applicator to form a layer having a wet thickness of 0.25 mil. This layer was dried at 135° C. for 5 minutes in a forced air oven to form a photogenerating layer having a dry thickness 0.4 micrometer. The next applied layer was a transport layer which was formed by using a Bird coating applicator to apply a solution containing one gram of N,N'-diphenyl-N,N'-bis(3-methyl-phenyl)-(1,1'-biphenyl)-4,4'-diamine and one gram of polycarbonate resin [poly(4,4'-isopropylidene-diphenylene carbonate (available as Makrolon® from Farbenfabricken Bayer A.G.) dissolved in 11.5 grams of methylene chloride solvent. The N,N'-diphenyl-N,N'-bis(3-methyl-phenyl)-(1,1'-biphenyl)-4,4'-diamine is an electrically active aromatic diamine charge transport small molecule whereas the polycarbonate resin is an electrically inactive film forming binder. The coated device was dried at 80° C. for half an hour in a forced air oven to form a dry 25 micrometer thick charge transport layer

EXAMPLE II

One of the devices of Example I was overcoated with an overcoat layer material of the prior art (cross linked overcoat of U.S. Pat. No. 5,702,854). The overcoat layer was prepared by mixing 10 grams of a 10 percent by weight solution of polyamide containing methoxymethyl groups (Luckamide 5003, available from Dai Nippon Ink) in a 90:10 weight ratio solvent of methanol and n-propanol and 10 grams of N,N'-diphenyl-N,N'-bis(3-hydroxyphenyl)-[1,1-biphenyl]-4,4"-diamine, a hydroxy functionalized aromatic diamine, in a roll mill for 2 hours. Immediately prior to the application of the overcoat layer mixture, 0.1 gram of oxalic acid was added and the resulting mixture was roll milled briefly to assure dissolution. This coating solution was applied to the photoreceptor using a #20 Mayer rod. This overcoat layer was air dried in a hood for 30 minutes. The air dried film was then dried in a forced air oven at 125° C. for 30 minutes. The overcoat layer thickness was approximately 3 micrometers. The oxalic acid caused crosslinking of the methoxymethyl groups of the polyamide to yield a tough, abrasion resistant, hydrocarbon liquid resistant top surface.

EXAMPLE III

One of the devices of Example I was overcoated with an overcoat layer material of this invention. The overcoat layer was prepared by mixing 10 grams of a 10 percent by weight solution of polyamide containing methoxymethyl groups (Luckamide 5003, available from Dai Nippon Ink) in a 90:10 weight ratio solvent of methanol and n-propanol and 1.0 gram N,N'-diphenyl-N,N'-bis(3-hydroxyphenyl)-[1,1'-biphenyl]-4,4'-diamine, a hydroxy functionalized aromatic diamine [DHTBD], and a 0.5 gram solution with 0.1 gram bis-(2-methyl-4-diethylaminophenyl)-phenylmethane [BDETPM] dissolved in 0.4 gram tetrahydrofuran in a roll mill for 2 hours. Immediately prior to application of the overcoat layer mixture, 0.08 gram of oxalic acid was added and the resulting mixture was roll milled briefly to assure dissolution. This coating solution was applied to the photoreceptor using a #20 Mayer rod. This overcoat layer was air dried in a hood for 30 minutes. The air dried film was then dried in a forced air oven at 125° C. for 30 minutes. The overcoat layer thickness was approximately 3 micrometers. The oxalic acid caused crosslinking of the methoxymethyl groups of the polyamide to yield a tough, abrasion resistant, hydrocarbon liquid resistant top surface.

EXAMPLE IV

Devices of Example II (device of U.S. Pat. No. 5,702,854) and Example III (device of this invention) were first tested for xerographic sensitivity and cyclic stability. Each photoreceptor device was mounted on a cylindrical aluminum drum substrate which was rotated on a shaft of a scanner. Each photoreceptor was charged by a corotron mounted along the periphery of the drum. The surface potential was measured as a function of time by capacitively coupled voltage probes placed at different locations around the shaft. The probes were calibrated by applying known potentials to the drum substrate. The photoreceptors on the drums were exposed by a light source located at a position near the drum downstream from the corotron. As the drum was rotated, the initial (pre-exposure) charging potential was measured by voltage probe 1. Further rotation leads to the exposure station, where the photoreceptor was exposed to monochromatic radiation of a known intensity. The photoreceptor was erased by light source located at a position upstream of charging. The measurements made included charging of the photoreceptor in a constant current of voltage mode. The photoreceptor was corona charged to a negative polarity. As the drum was rotated, the initial charging potential was measured by voltage probe 1. Further rotation lead to the exposure station, where the photoreceptor was exposed to monochromatic radiation of known intensity. The surface potential after exposure was measured by voltage probes 2 and 3. The photoreceptor was finally exposed to an erase lamp of appropriate intensity and any residual potential was measured by voltage probe 4. The process was repeated with the magnitude of the exposure automatically changed during the next cycle. The photodischarge characteristics were obtained by plotting the potentials at voltage probes 2 and 3 as a function of light exposure. The charge acceptance and dark decay were also measured in the scanner. The residual potential was equivalent (15 volts) for both photoreceptors and no cycle-up was observed when cycled for 10,000 cycles in a continuous mode. The overcoat layer of this invention clearly did not introduce any deficiencies.

EXAMPLE V

Deletion resistance test: A negative corotron was operated (with high voltage connected to the corotron wire) opposite a grounded electrode for several hours. The high voltage was turned off, and the corotron was placed (parked) for thirty minutes on a segment of the photoconductor device being tested. Only a short middle segment of the photoconductor device was thus exposed to the corotron effluents. Unexposed regions on either side of the exposed regions were used as controls. The photoconductor device was then tested in a scanner for positive charging properties for systems employing donor type molecules. These systems were operated with negative polarity corotron in the latent image formation step. An electrically conductive surface region (excess hole concentration) appears as a loss of positive charge acceptance or increased dark decay in the exposed regions (compared to the unexposed control areas on either side of the short middle segment). Since the electrically conductive region is located on the surface of the photoreceptor device, a negative charge acceptance scan is not affected by the corotron effluent exposure (negative charges do not move through a charge transport layer made up of donor molecules). However, the excess carriers on the surface cause surface conductivity resulting in loss of image resolution, and in severe cases, causes deletion. The photoreceptor device of Example II of the prior art and of Example III of the present invention were tested for deletion resistance. The region not exposed to corona effluents charged to 1000 volts positive in all devices. However the corona exposed region of the device of Example II of the prior art charged to 500 volts (a loss of 500 volts of charge acceptance) whereas the corona exposed regions of the devices of Examples III was charged to 875 volts (a loss of only 125 volts of charge acceptance). Thus, the composition of this invention has improved deletion resistance by a factor of slightly over 4.

EXAMPLE VI

Electrophotographic imaging members were prepared by applying by dip coating a charge blocking layer onto the rough surface of eight aluminum drums having a diameter of 4 cm and a length of 31 cm. The blocking layer coating mixture was a solution of 8 weight percent polyamide (nylon 6) dissolved in 92 weight percent butanol, methanol and water solvent mixture. The butanol, methanol and water mixture percentages were 55, 36 and 9 percent by weight, respectively. The coating was applied at a coating bath withdrawal rate of 300 millimeters/minute. After drying in a forced air oven, the blocking layers had thicknesses of 1.5 micrometers. The dried blocking layers were coated with a charge generating layer containing 2.5 weight percent hydroxy gallium phthalocyanine pigment particles, 2.5 weight percent polyvinylbutyral film forming polymer and 95 weight percent cyclohexanone solvent. The coatings were applied at a coating bath withdrawal rate of 300 millimeters/minute. After drying in a forced air oven, the charge generating layers had thicknesses of 0.2 micrometer. The drums were subsequently coated with charge transport layers containing N,N'-diphenyl-N,N'-bis(3-methylphenyl)-1,1;-biphenyl-4,4'-diamine dispersed in polycarbonate (PCZ200, available from the Mitsubishi Chemical Company). The coating mixture consisted of 8 weight percent N,N'-diphenyl-N,N'-bis(3-methylphenyl)-1,1'-biphenyl-4,4;-diamine, 12 weight percent binder and 80 weight percent monochlorobenzene solvent. The coatings were applied in a Tsukiage dip coating apparatus. After drying in a forced air oven for 45 minutes at 118° C., the transport layers had thicknesses of 20 micrometers.

EXAMPLE VII

The drum of Example VI was overcoated with an overcoat layer of this invention containing N,N'-diphenyl-N,N'-bis(3-hydroxyphenyl)-[1,1'-biphenyl]-4,4'-diamine (a hydroxy functionalized aromatic diamine) and polyamide (Luckamide 5003, available from Dai Nippon Ink). 10 grams of a 10 percent weight solution of Luckamide 5003 in a 50:50 weight ratio solvent of methanol and propanol and 1.0 gram of N,N'-diphenyl-N,N'-bis( 3-hydroxyphenyl)-[1,1'-biphenyl]-4,4'-diamine were roll milled for 2 hours. To this added 0.1 gram of bis-(2-methyl-4-diethylaminophenyl)-phenylmethane [BDETPM] mixed in 0.4 gram of tetrahydrofuran, and then allowed to stand for several hours before use. 0.08 gram of oxalic acid was then added to the mixture. 3 micrometer thick overcoats are applied in the dip coating apparatus with a pull rate of 190 millimeters/min. The overcoated drum was dried at 125° C. for 1 hour. The photoreceptor was print tested in a Xerox 4510 machine for 500 consecutive prints. There was no loss of image sharpness, no problem with background or any other defect resulting from the overcoats.

EXAMPLE VIII

An unovercoated drum of Example VI and an overcoated drum of Example VII were tested in a wear fixture that contained a bias charging roll for charging. Wear was calculated in terms of nanometers/kilocycles of rotation (nm/Kc). Reproducibility of calibration standards was about ±2 nm/Kc. The wear of the drum without the overcoat of Example VI was greater than 80 nm/Kc. Wear of the overcoated drums of this invention of Example VII was ~20 nm/Kc. Thus, the improvement in resistance to wear for the photoreceptor of this invention, when subjected to bias charging roll cycling conditions, was very significant.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a substrate, a charge generating layer, a charge transport layer, and an overcoat layer comprising a uniform homogeneous blend of a hole transporting hydroxy arylamine compound having at least two hydroxy functional groups, bis-(2-methyl-4-diethylaminophenyl)-phenylmethane and a cross linked polyamide film forming binder.

2. An electrophotographic imaging member according to claim 1 wherein the polyamide film forming binder prior to cross linking is a crosslinkable alcohol soluble polyamide polymer having methoxy methyl groups attached to the nitrogen atoms of the amide groups in the polyamide backbone.

3. An electrophotographic imaging member according to claim 1 wherein the overcoat layer comprises between about 30 percent by weight and about 70 percent by weight of the cross linked polyamide film forming binder, based on the total weight of the overcoat.

4. A process comprising forming a coating solution comprising bis-(2-methyl-4-diethylaminophenyl)-phenylmethane, an alcohol miscible nonalcoholic solvent for bis-(2-methyl-4-diethylaminophenyl)-phenylmethane, a hole transporting hydroxy arylamine compound having at least two hydroxy functional groups, an alcohol and a cross linkable polyamide film forming binder, providing a substrate coated with at least one electrophotographic imaging layer, forming a coating with the coating solution on the at least one electrophotographic imaging layer, and drying the coating and cross linking the polyamide to form an overcoating layer.

5. A process according to claim 4 wherein the nonalcoholic solvent is tetrahydrofuran.

6. A process according to claim 4 wherein the nonalcoholic solvent is chlorobenzene.

7. A process according to claim 4 wherein the cross linkable polyamide film forming binder is polyamide polymer having methoxy methyl groups attached to the nitrogen atoms of amide groups in the polymer backbone prior to cross linking.

8. A process according to claim 4 wherein the alcohol is selected from the group consisting of methanol, ethanol, butanol and mixtures thereof.

9. A process according to claim 4 including cross linking the polyamide with a catalyst and heat.

10. A process according to claim 4 including forming the coating solution by dissolving bis-(2-methyl-4-diethylaminophenyl)-phenylmethane in the alcohol miscible nonalcoholic solvent for bis-(2-methyl-4-diethylaminophenyl)-phenylmethane prior to combination with the hole transporting hydroxy arylamine compound, the alcohol and the cross linkable polyamide film forming binder.

11. A process according to claim 4 wherein the coating solution comprises between about 1 percent and about 15 percent by weight of the alcohol miscible nonalcoholic solvent for bis-(2-methyl-4-diethylaminophenyl)-phenylmethane and between about 85 percent and about 99 percent by weight of the alcohol, based on the combined weight of the alcohol miscible nonalcoholic solvent for bis-(2-methyl-4-diethylaminophenyl)-phenylmethane and the alcohol.

12. A process according to claim 4 wherein the at least one electrophotographic imaging layer comprises a charge generating layer and a charge transport layer substantially free of triphenyl methane.

13. A process according to claim 12 wherein the charge transport layer comprises a charge transporting small molecule dissolved or molecularly dispersed in a film forming electrically inert polymer, the film forming electrically inert polymer being insoluble in the alcohol solvent in the coating solution used to form the overcoat layer.

* * * * *